US011988076B2

(12) United States Patent
Williams et al.

(10) Patent No.: US 11,988,076 B2
(45) **Date of Patent: *May 21, 2024**

(54) METHOD FOR ASSEMBLING A LINER SYSTEM

(71) Applicants: Jeffrey Williams, Cypress, TX (US); Andy Tom, Houston, TX (US); Matthew Krueger, Cypress, TX (US)

(72) Inventors: Jeffrey Williams, Cypress, TX (US); Andy Tom, Houston, TX (US); Matthew Krueger, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 186 days.

This patent is subject to a terminal disclaimer.

(21) Appl. No.: 17/716,728

(22) Filed: Apr. 8, 2022

(65) Prior Publication Data

US 2023/0323757 A1 Oct. 12, 2023

(51) Int. Cl.
*E21B 43/10* (2006.01)

(52) U.S. Cl.
CPC ..... *E21B 43/103* (2013.01)

(58) Field of Classification Search
CPC ..... E21B 43/10; E21B 43/103; E21B 43/106
See application file for complete search history.

(56) References Cited

U.S. PATENT DOCUMENTS

| | | | |
|---|---|---|---|
| 5,318,120 | A | 6/1994 | Hisaw |
| 7,395,857 | B2 | 7/2008 | Hillis |
| 7,607,476 | B2 | 10/2009 | Tom et al. |
| 8,579,024 | B2 | 11/2013 | Mailand et al. |
| 8,887,818 | B1 | 11/2014 | Carr et al. |
| 10,662,732 | B2 | 5/2020 | Frazier |
| 10,955,076 | B2 | 3/2021 | Schippers et al. |
| 2001/0017210 | A1 | 8/2001 | Howlett |
| 2003/0106696 | A1* | 6/2003 | Lauritzen ..... E21B 29/005 166/207 |
| 2003/0141079 | A1* | 7/2003 | Doane ..... E21B 33/1208 166/134 |
| 2004/0256098 | A1 | 12/2004 | Ducasse et al. |
| 2005/0189120 | A1 | 9/2005 | Doane et al. |
| 2005/0263279 | A1 | 12/2005 | Vachon |
| 2006/0006647 | A1 | 1/2006 | Hashem et al. |

(Continued)

FOREIGN PATENT DOCUMENTS

| | | | |
|---|---|---|---|
| CN | 204703811 | U | 10/2015 |
| JP | 2016522876 | A | 8/2016 |

(Continued)

OTHER PUBLICATIONS

International Search Report and Written Opinion; PCT/US2023/017738; Korean Intellectual Property Office; dated Apr. 6, 2023; 12 pages.

(Continued)

*Primary Examiner* — George S Gray
(74) *Attorney, Agent, or Firm* — CANTOR COLBURN LLP

(57) ABSTRACT

A method for assembling a liner system including disposing from an uphole end of the liner a first slip subsystem, disposing from the uphole end of the liner a seal, and disposing from the uphole end of the liner a second slip subsystem.

7 Claims, 4 Drawing Sheets

(56) References Cited

U.S. PATENT DOCUMENTS

| | | | | |
|---|---|---|---|---|
| 2008/0047704 | A1 | 2/2008 | Tom et al. | |
| 2014/0345880 | A1 | 11/2014 | Enis et al. | |
| 2016/0032680 | A1 | 2/2016 | Krueger et al. | |
| 2018/0363428 | A1 | 12/2018 | Rice | |
| 2019/0203559 | A1* | 7/2019 | Ezell | E21B 33/1295 |
| 2020/0217424 | A1 | 7/2020 | Rasmussen et al. | |
| 2021/0396086 | A1* | 12/2021 | Payne | E21B 33/12955 |
| 2022/0049573 | A1* | 2/2022 | Jacob | E21B 19/24 |
| 2023/0323745 | A1 | 10/2023 | Williams et al. | |
| 2023/0323758 | A1 | 10/2023 | Williams et al. | |

FOREIGN PATENT DOCUMENTS

| | | | | |
|---|---|---|---|---|
| WO | 2013148015 | A1 | 10/2013 | |
| WO | 2015163902 | A1 | 10/2015 | |
| WO | WO-2015163902 | A1 * | 10/2015 | E21B 43/10 |
| WO | 2018231381 | A1 | 12/2018 | |

OTHER PUBLICATIONS

International Search Report and Written Opinion; PCT/US2023/017562; Korean Intellectual Property Office; dated Jul. 19, 2023; 12 pages.

International Search Report and Written Opinion; PCT/US2023/017747; Korean Intellectual Property Office; dated Jul. 26, 2023; 12 pages.

International Search Report and Written Opinion; PCT/US2023/017750; Korean Intellectual Property Office; dated Jul. 18, 2023; 11 pages.

* cited by examiner

METHOD FOR ASSEMBLING A LINER SYSTEM

BACKGROUND

In the resource recovery and fluid sequestration industries, there is often need to install liners in boreholes. While liner configurations are well known and have been installed in many ways, there is still a concern regarding pressure issues that can have an undesirable impact on reliability at the hanger and concerns about collapse and burst ratings. The art will well receive alternatives that improve reliability and also improve burst and collapse ratings.

SUMMARY

An embodiment of a method for assembling a liner system including disposing from an uphole end of the liner a first slip subsystem, disposing from the uphole end of the liner a seal, and disposing from the uphole end of the liner a second slip subsystem.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
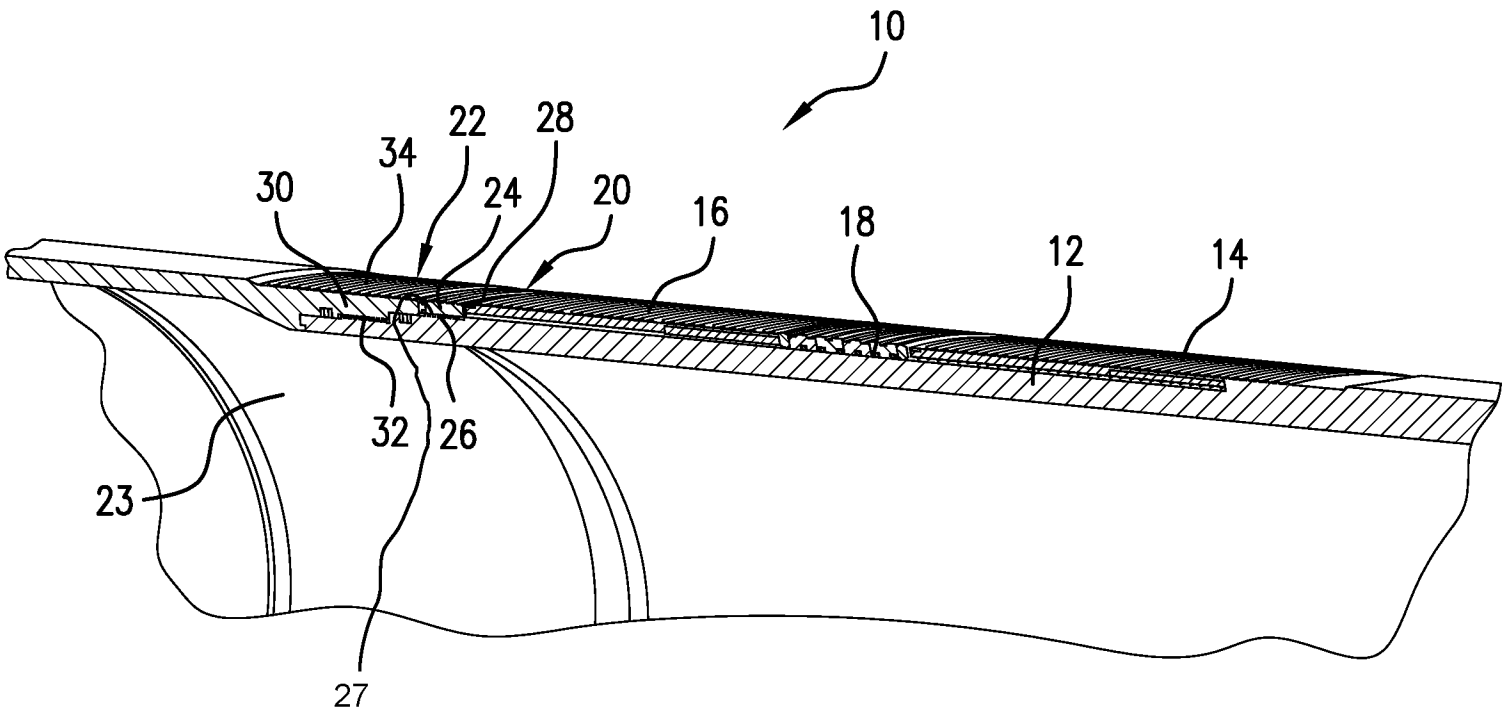
FIG. 1 is a perspective view of an expandable liner system as disclosed herein.

Referring to FIG. 1, a perspective section view of an expandable liner system 10 is illustrated. The system comprises a liner 12, a first slip subsystem 14, a second slip subsystem 16, a seal 18 located between the first and second slip subsystems 14, 16, a lock ring 20 and an anchor 22. During consideration of the system 10 it is to be appreciated that all components are assembled from one end of the liner 12. This provides a distinct advantage over prior art systems in that slip and burst/collapse ratings are higher due to the fact that there is no lapping thread in the liner below a hanger upon which the system 10 is hung as there is in the prior art. The liner 12 in system 10 is full thickness below the hanger (not shown this figure) and thereby capable of burst and collapse ratings much higher than would be a liner with a threadform cut therein. Further, the anchor 22 may be configured with a polished bore 23 therein that is still above the hanger while still supporting assembly from the one end of the liner as noted above.

System 10 includes both a first and second slip subsystem 14, 16 with the seal 18 therebetween because the assembly protects load capacity rating. Seal 18 prevents pressure events from one side of the system 10 from reaching both of the slip subsystems. Therefore, were a pressure event to occur from downhole of the system 10, the liner 12 might be compressed to some extent that could undermine the engagement of the first slip system 14 with the hanger causing that slip subsystem to have a significantly lower load capacity rating. Seal 18 however, prevents that pressure event from also compromising the second slip subsystem 16 and rather allows that system to remain in perfect working order, thereby maintaining the load capacity rating. Alternatively, if a pressure event occurred uphole of the system 10, the casing (not shown this figure) could balloon, thereby undermining the rating of the second slip subsystem 16 by reducing the engagement of the second slip subsystem 16 with the hanger. The second slip subsystem would therefore be derated in this condition but due to the seal 18, the first slip subsystem 14 would be unaffected by the pressure event and hence would maintain the full load capacity rating.

Figure 2:
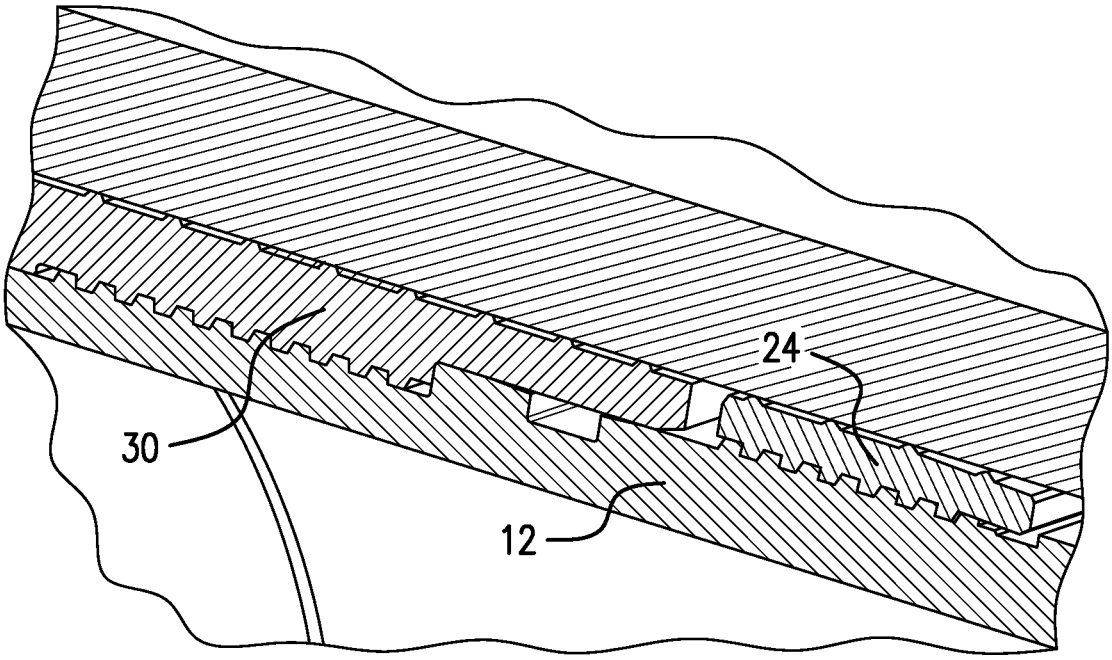
FIG. 2 is a view illustrating the expansion threads.
Figure 3:
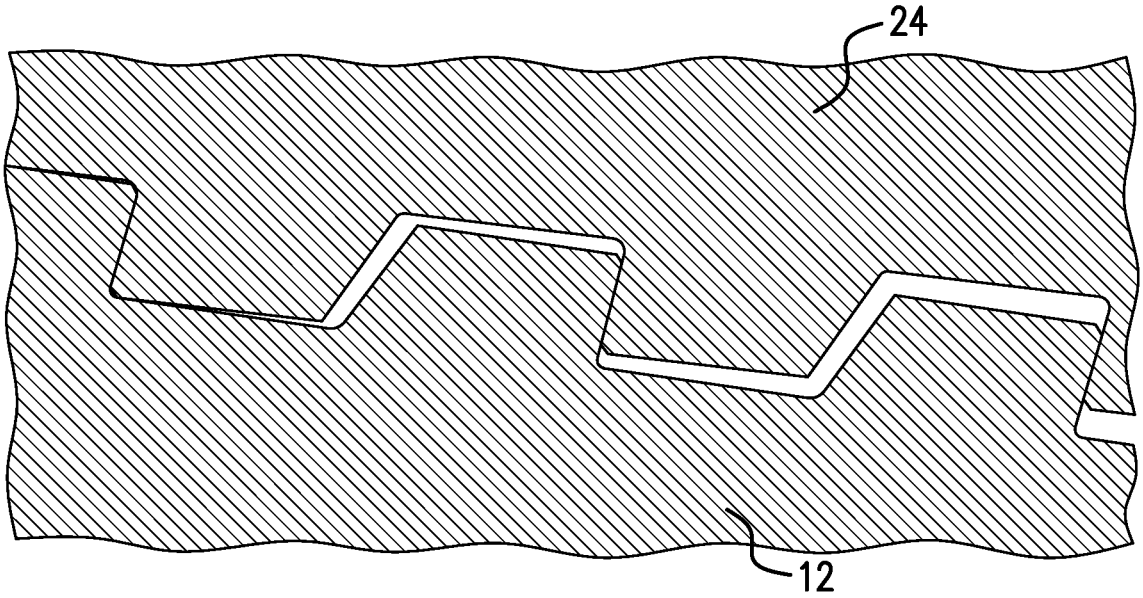
FIG. 3 illustrated how the threads move under deformation.

From FIG. 1, it is also apparent that the slip subsystems 14, 16 and the seal 18 are tightly packaged axially ("axially" being used to refer to the longitudinal extent of the liner 12) upon the liner 12. The slip subsystems and the seal are maintained in this position for run in by the lock ring 20. Lock ring 20 includes a lock ring body 24, an inside surface thread 26 and an outside surface wicker 28. Thread 26 is to be mated to a matching male thread 27 (see FIGS. 2 and 3) on an outside surface of the liner 12. Threads 26 and 27 are required to remain engaged both pre and post expansion of the liner 12. During expansion, threads are moved and stretched such that commonly a subset of the total number of threads are actually engaged, In some cases, which can be understood from the angles illustrated in FIG. 3 there are only two or three threads actually bearing upon each other due to the deformation of the members during the expansion. Even though there are only two or three threads engaged, they still must not shear or the expansion would result in a failure. It has been determined by the inventors hereof that the load flank must maintain at least about ½ engagement (e.g. 50% of thread height) of the threads that are engaged throughout the expansion process while thread width should be about 20-50% greater than thread height. The wicker 28 may be one or more wickers and in embodiments may be hardened. It is noted that hardened wickers for this component are contemplated because it is acceptable for the lock ring 20 to split during expansion since its functions are to hold the subsystems 14 and 16 and the seal 18 in place for run in and then to potentially assist in restricting longitudinal movement of the liner during expansion. It is known that when tubular members are expanded, they change in axial length and hence have a component of movement in the longitudinal direction. This kind of movement when setting slips causes one or more of the wickers to poorly engage the complementary structure because they are moving longitudinally while moving radially into engagement. This is particularly true in an expansion situation using a swage because the radial expansion happens over time from one end of the tubular member to the other and hence the wickers brought into engagement first are only one or two, for example, and have relatively little longitudinal holding power. Those two will then slide longitudinally gouging the complementary structure (here the hanger) and have little load capacity. The restriction of liner longitudinal movement is desirable because it ensures that for slip subsystems 14 and 16, all of the teeth (wickers) thereon will be fully engaged without a sliding movement rather than the first few wickers to engage sliding axially and thereby reducing their holding power. The lock ring 20 assists in this by reducing the longitudinal axial movement of the liner 12 since the wicker(s) 28 of the lock ring 20 engages the hanger prior to the slip subsystems engaging the hanger and thereby reduces potential longitudinal movement that might otherwise have occurred during expansion of the slip subsystem portions of the liner 12.

In addition to the foregoing, the anchor 22 includes an anchor body 30 having an inside surface thread 32 and an outside surface wicker 34. Thread 32 is another pre and post expansion engagement type thread similar to that of the lock ring 20. The anchor differs in that the wicker(s) 34 are not hardened since the splitting of the anchor 22 during expansion is not permitted. Rather, the anchor must remain a sealed component after expansion. It will also be noted that relatively more wickers 34 are provided on anchor 22 than are provided on lock ring 20. This is directly related to the deformation resistance of each wicker. Hardened wickers have substantially greater resistance to deformation relative to nonhardened wickers and accordingly fewer are needed to provide a desired amount of movement limitation.

In embodiments, it is contemplated that the lock ring 20 could be omitted by extending the length of the anchor to substitute for the lock ring 20 job of compressing the slip subsystems and seal for running.

Figure 4:
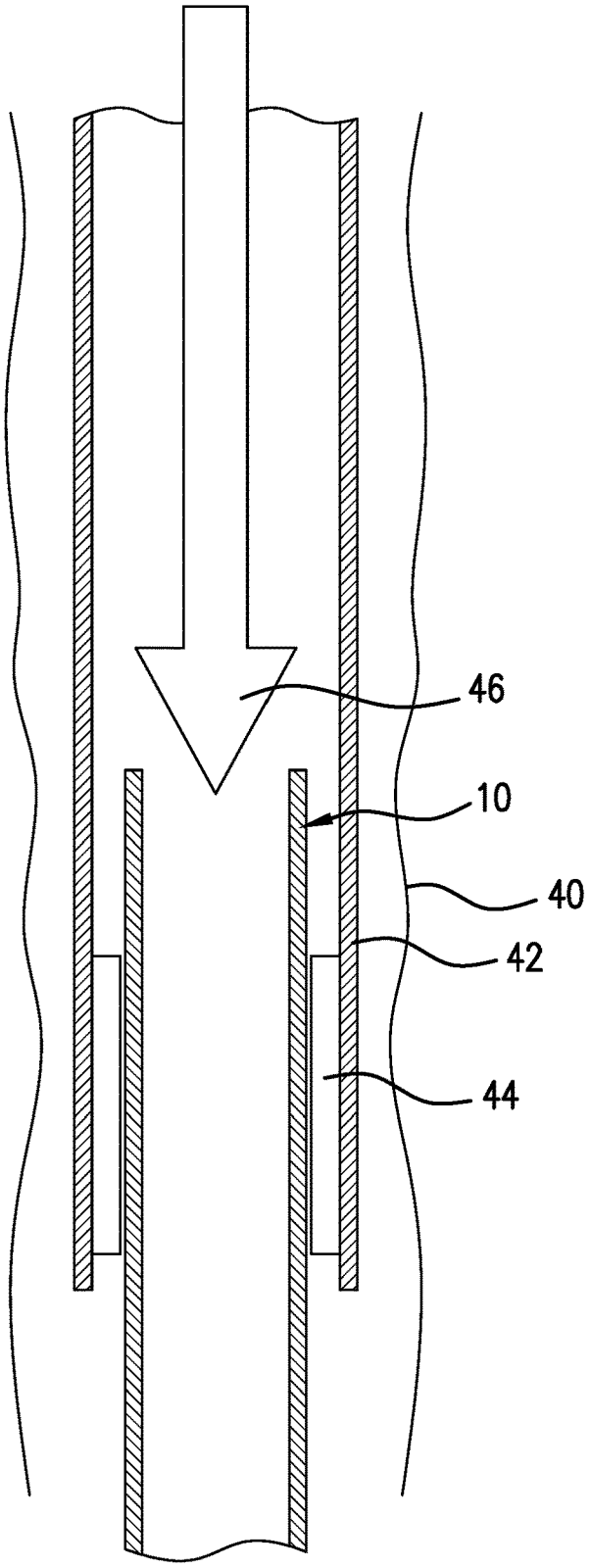
FIG. 4 is a schematic view of the liner system disclosed herein being set in a borehole.

During use, and referring to FIG. 4, the system 10 is run in the borehole 40 into a parent casing 42 having a liner hanger 44. The system 10 is easy to run because it has a reduced diameter. Once the system 10 reaches the hanger 44, a swage 46 is run through the system 10 to expand the same thereby preparing the borehole 40 for further activities.

One of the benefits of the system 10 is that tit allows the used of softer less expensive low alloy steel materials, for example, without burst and collapse rating reductions.

Figure 5:
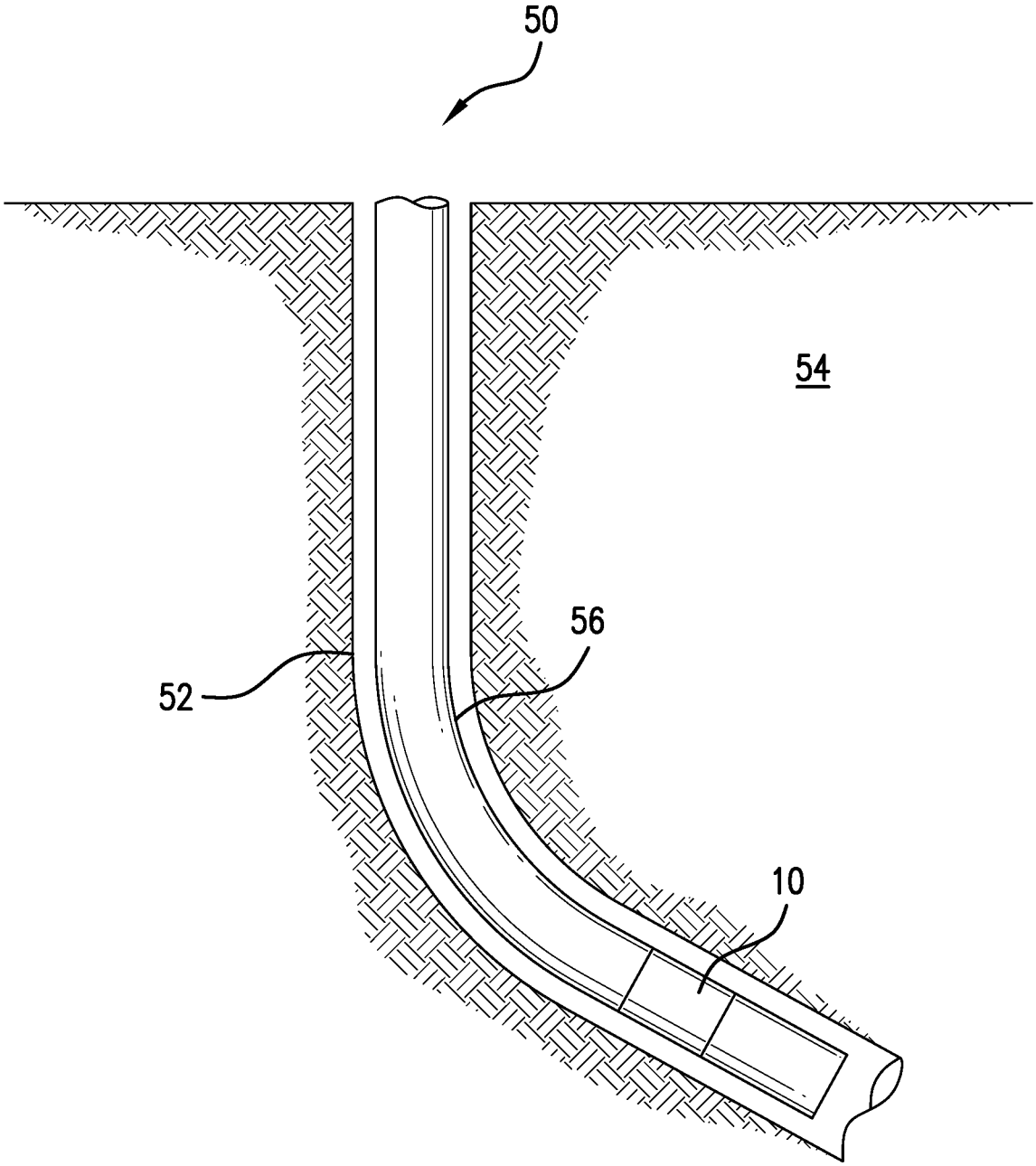
FIG. 5 is a view of a borehole system including the expandable liner system disclosed herein.

Referring to FIG. 5, a borehole system 50 including the system 10 comprises a borehole 52 in a subsurface formation 54. A casing 56 is disposed within the borehole 52. And the liner system 10 is disposed within the casing 56.

Set forth below are some embodiments of the foregoing disclosure:

Embodiment 1: A method for assembling a liner system including disposing from an uphole end of the liner a first slip subsystem, disposing from the uphole end of the liner a seal, and disposing from the uphole end of the liner a second slip subsystem.

Embodiment 2: The method as in any prior embodiment wherein the seal is in contact with the first slip subsystem.

Embodiment 3: The method as in any prior embodiment wherein the seal is in contact with the second slip subsystem.

Embodiment 4: The method as in any prior embodiment, further including disposing from the uphole end of the liner a lock ring.

Embodiment 5: The method as in any prior embodiment including threading the anchor onto the liner using an expansion thread.

Embodiment 6: The method as in any prior embodiment including tightening the lock ring against the first slip subsystem such that the first slip subsystem, the second slip subsystem and the seal are axially tightly packaged against one another by the lock ring.

Embodiment 7: The method as in any prior embodiment, further including disposing at the uphole end of the liner, an anchor.

Embodiment 8: The method as in any prior embodiment including threading the anchor onto the liner using an expansion thread.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for assembling a liner system comprising:
disposing from an uphole end of the liner a first slip subsystem;
disposing from the uphole end of the liner a seal;
disposing from the uphole end of the liner a second slip subsystem;
disposing at the uphole end of the liner, and anchor; and
threading the anchor onto the liner using an expansion thread.

2. The method as claimed in claim 1 wherein the seal is in contact with the first slip subsystem.

3. The method as claimed in claim 2 wherein the seal is in contact with the second slip subsystem.

4. The method as claimed in claim 1, further comprising:
disposing from the uphole end of the liner a lock ring.

5. The method as claimed in claim 4 including tightening the lock ring against the first slip subsystem such that the first slip subsystem, the second slip subsystem and the seal are axially packaged against one another by the lock ring.

6. A method for assembling a liner system comprising:
disposing from an uphole end of the liner a first slip subsystem;
disposing from the uphole end of the liner a seal;

disposing from the uphole end of the liner a second slip subsystem;

disposing from the uphole end of the liner a lock ring; and tightening the lock ring against the first slip subsystem such that the first slip subsystem, the second slip subsystem and the seal are axially packaged against one another by the lock ring.

7. A method for assembling a liner system comprising:

disposing from an uphole end of the liner a first slip subsystem;

disposing from the uphole end of the liner a seal;

disposing from the uphole end of the liner a second slip subsystem; and threading an anchor onto the liner using an expansion thread.

* * * * *